US005890605A

United States Patent [19]

Percudani

[11] Patent Number: 5,890,605

[45] Date of Patent: Apr. 6, 1999

[54] ARTICLE ORGANIZER

[76] Inventor: Gene P. Percudani, HC#1 Box 1049A, Tannersville, Pa. 18372

[21] Appl. No.: 850,770

[22] Filed: May 2, 1997

[51] Int. Cl.[6] ..... A47F 5/00

[52] U.S. Cl. ..... 211/87.01; 211/60.1; 211/70.6; 211/119.009; 248/315; D6/526; D6/527

[58] Field of Search ..... 211/60.1, 70.6, 211/65, 88.01, 87.01, 119.009, 90.01; 248/315, 311.2; D6/526, 535, 532, 540, 527

[56] References Cited

U.S. PATENT DOCUMENTS

| | | | |
|---|---|---|---|
| 1,713,275 | 5/1929 | Gibson | 211/88.01 |
| 1,981,674 | 11/1934 | Solomon . | |
| 2,200,046 | 5/1940 | Straus | 211/65 X |
| 2,248,916 | 7/1941 | Opper . | |
| 2,432,818 | 12/1947 | Schults . | |
| 2,450,337 | 9/1948 | Hearst | 211/119.009 X |
| 2,576,303 | 11/1951 | Matter . | |
| 2,979,211 | 4/1961 | Fritzel | 211/119.009 |
| 3,138,414 | 6/1964 | Pollo . | |
| 3,228,737 | 1/1966 | Kipnis . | |
| 3,306,689 | 2/1967 | Isaacson et al. . | |
| 3,384,243 | 5/1968 | Davis . | |
| 4,008,808 | 2/1977 | Ramsay . | |
| 4,023,872 | 5/1977 | Palka et al. . | |
| 4,134,625 | 1/1979 | Palka . | |
| 4,566,597 | 1/1986 | Caputo et al. | 211/65 |
| 4,998,700 | 3/1991 | McKaig | 248/311.2 X |
| 5,332,107 | 7/1994 | Williams . | |
| 5,524,980 | 6/1996 | Carter et al. . | |

*Primary Examiner*—Robert W. Gibson, Jr.
*Attorney, Agent, or Firm*—Blank Rome Comisky & McCauley LLP

[57] ABSTRACT

An article organizer for use as an insert in a medicine cabinet or for wall mounting for holding a plurality of articles includes a top wall, a bottom wall, a rear wall and two side walls, the bottom wall having at least one slot for holding a respective one of the articles or facilitating its removal. At least one of the side walls has a groove for receiving a corresponding protruding portion of an attachment to the organizer. The organizer also includes at least one inner vertical wall connected to the top and rear walls and an inner horizontal wall connected to one or more inner vertical walls. The inner horizontal wall has a slot formed therein for holding a respective one of the articles or facilitating removal thereof. Cup holder, soap dish and/or flat shelf attachments are provided with a protruding portion for connection to the groove of the organizer.

13 Claims, 2 Drawing Sheets

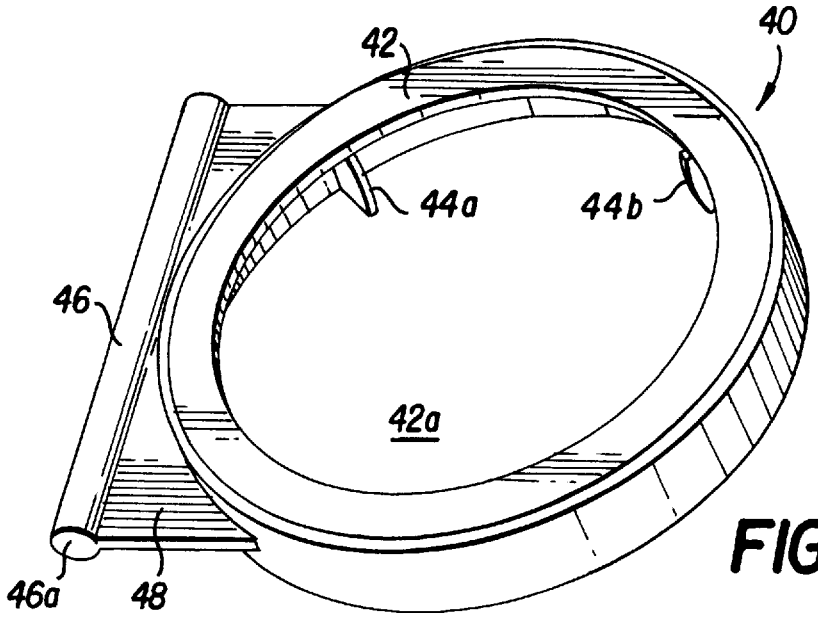
FIG. 3
FIG. 4
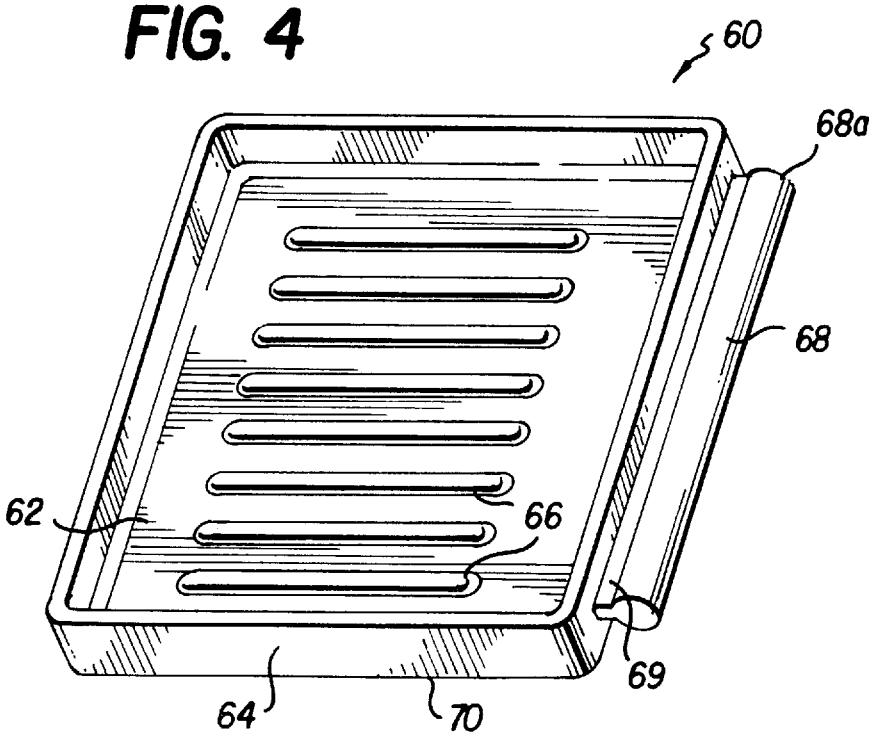

ARTICLE ORGANIZER

FIELD OF THE INVENTION

The present invention generally relates to an article, organizer for wall mounting or as an insert for a medicine cabinet, and more particularly an organizer having various compartments and removable attachments for holding individual articles normally found in a home, such as in a bathroom or in the vicinity of a medicine cabinet (for example, soap, razor, razor blades, dental floss, toothbrushes, toothpaste, cosmetics and water cup) and also functions as a shelf in the medicine cabinet or on a wall.

DESCRIPTION OF THE PRIOR ART

Many individuals place various toilet and cosmetic articles, such as those mentioned above, on a bathroom sink or on a countertop adjacent thereto which leads to a very cluttered appearance of the bathroom. A medicine cabinet is useful to avoid such a cluttered appearance, however, medicine cabinets typically have several vertically adjustable shelves and perhaps a toothbrush holder for storing toilet articles and do not provide specialized compartments for individual toilet articles. Heretofore, a number of different containers and holders have been designed to hold the various types of toilet articles normally found in the bathroom. Typical of such containers or holders are those disclosed in the following U.S. Pat. Nos. 1,981,674; 2,432,818; 2,576,303; 3,138,414; 3,228,737; 3,306,689; 3,384,243; 4,008,808; and 5,332,107.

However, such containers and holders have various disadvantages, the primary disadvantage being that only a limited number of articles can be contained or held by such devices. Moreover, if a person attempts to install a number of such devices (typically, by fixing them to the wall surface), the result is a very crowded wall area. Such an approach also leads to an untidy appearance in the bathroom area. Accordingly, prior practitioners have designed various types of medicine cabinets or similar devices for holding the various toiletry articles normally found in the bathroom. Examples of such cabinets can be found in the following U.S. Pat. Nos. 2,248,916; 4,023,872; and 4,134,625. Despite the advantages of a bathroom cabinet, only a certain number of toiletry articles can be stored therein. If one attempts to store too many toiletry articles in such a cabinet, it becomes necessary to stack article upon article, and often articles will fall out of the medicine cabinet when it is opened. Moreover, the crowding of too many articles in such a cabinet sacrifices organization, and it is often quite difficult to find a particular toiletry article when numerous articles of that type are stored in a single cabinet.

As a result, there have been some attempts in the past to develop medicine cabinet organizing inserts. Such an insert is disclosed in U.S. Pat. No. 5,524,980. However, such inserts are often not efficient in their design, and thus are not capable of holding or containing a maximum number of toiletry articles of various types in a very efficient and space-saving manner.

Therefore, there is a need in the prior art for an improved medicine cabinet organizing insert, and in particular, an insert which is able to accommodate a wide variety of toiletry articles, and to store those articles in a most efficient and spacesaving manner. There is also a need for a wall-mounted article organizer that supports and stores many different types of articles in a neat, efficient and spacesaving way.

SUMMARY OF THE INVENTION

The present invention generally relates to an organizer insert for a medicine cabinet, and more particularly to an improved insert for containing and organizing a wide variety of toiletry articles, while storing the articles in a most efficient and space-saving manner.

More specifically, the organizer insert for a medicine cabinet of the present invention has compartments for a wide variety of toiletry articles, specifically, for soap, razor, razor blades, dental floss, toothbrushes, toothpaste, and a water cup, and also functions as a shelf in the medicine cabinet. Moreover, the organizer insert is molded in a single piece for ease of installation in, as well as removal from, the medicine cabinet in which it is installed. The organizer insert is also provided, on at least one side, with one or more grooves for removably receiving a corresponding protruding portion or protruding portions of one or more specialized attachments to be connected to the organizer insert. Such attachments include a cup holder, a soap dish, or the like.

It is, therefore, a primary object of the present invention to provide an articler organizer for wall mounting or as an insert for a medicine cabinet with specialized attachments that can be selectively installed by the user to suit the user's particular desires or requirements.

It is another object of the present invention to provide an organizer insert which is able to accommodate a wide variety of toiletry articles and also function as a shelf in a medicine cabinet.

A further object of the present invention is to provide an organizer insert, the main portion of which is molded in a single piece.

Yet another object of the present invention is to provide an organizer insert which is easily installed in, or removed from, a wall or the medicine cabinet with which it is associated.

It is an additional object of the present invention to provide an organizer insert to which one or more specialized attachments can be easily connected and removed.

Another object of the present invention is to provide an organizer insert in combination with a removable cup holder.

Another object of the present invention is to provide a medicine cabinet organizer insert in combination with a removable soap dish which, when inverted, functions as a shelf extension.

The above and other objects, advantages and features of the invention will be more clearly understood by reference to the following detailed description, the associated drawings, and the appended claims.

BRIEF DESCRIPTION OF DRAWINGS

FIG. 3 is a perspective view of a cup holder attachment adapted for use in conjunction with the organizer insert of FIG. 1; and FIG. 4 is a soap dish/shelf extension attachment adapted for use in conjunction with the organizer insert of FIG. 1.

DETAILED DESCRIPTION OF THE INVENTION

Figure 1:
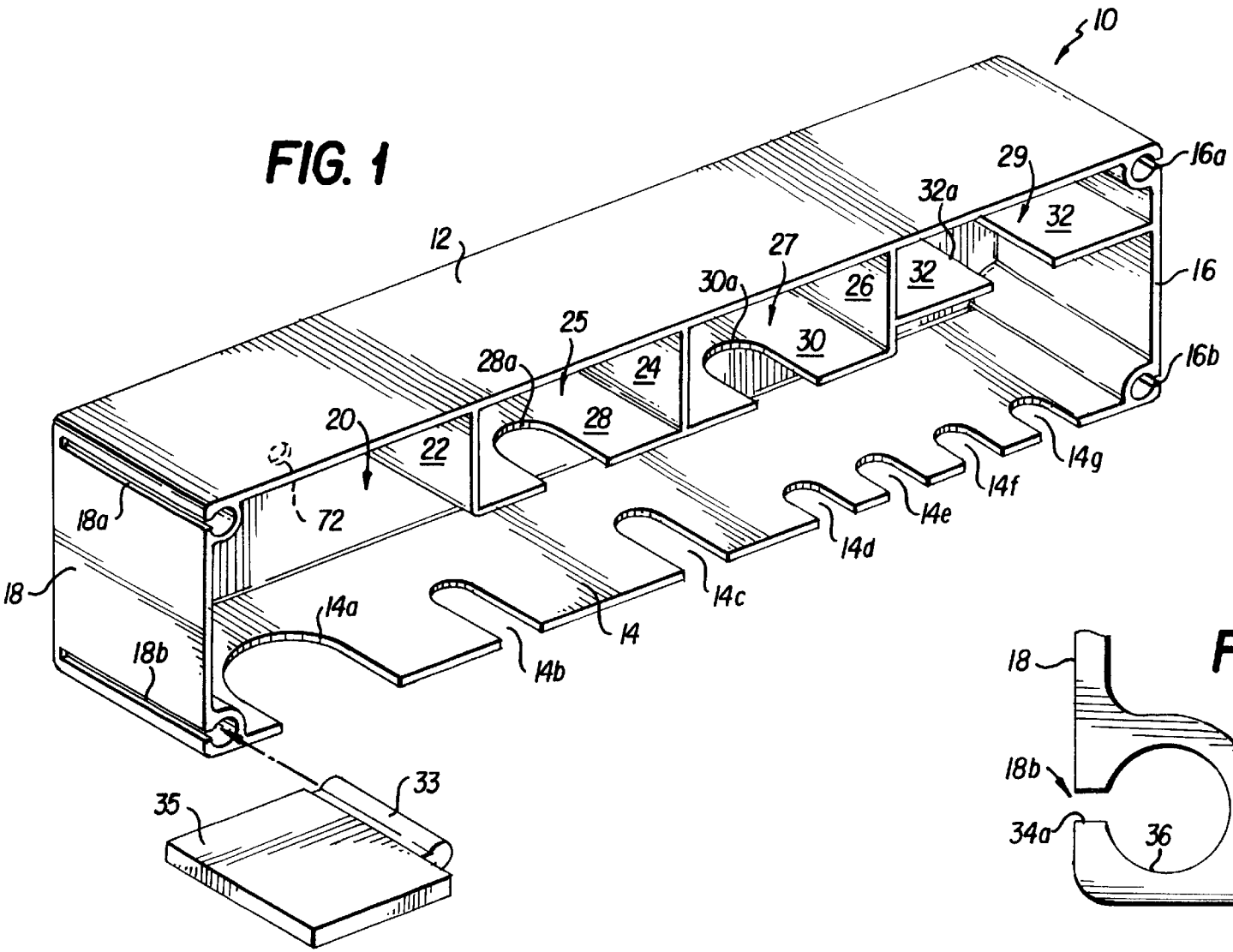
FIG. 1 is an exploded perspective view of the organizer insert of the present invention showing the use of one specialized insert.

The invention will now be described in more detail with reference to the various figures of the drawings. Referring first to the FIG. 1 perspective view of the present invention, organizer insert 10 comprises top panel 12, bottom panel 14, side panels 16 and 18, and rear panel 20. Side panels 16 and 18 are provided with elongated grooves 16*a*, 16*b* and 18*a*, 18*b*, respectively, the purpose of which will be described in more detail below.

Bottom panel 14 is provided with a plurality of slots 14*a*–14*g*, some of which serve to accommodate or hold a particular article and others of which are designed to facilitate removal of the article from the organizer. For example, larger slot 14*a* may be used to suspend a relatively large toiletry article, such as a tube of tooth paste. The area of the bottom panel 14 surrounding the slot 14*a* may also be used to support a toiletry article or container such as a cosmetic container. In such case, the slot 14*a* facilitates removal of the article or container since the index finger may be passed through the slot to grasp the bottom of the article or container. Smaller slots 14*b* and 14*c* are designed for suspending smaller toiletry articles, such as a razor. Still smaller slots 14*d*–14*g* are designed for suspending even smaller articles, such as toothbrushes and the like.

In accordance with the present invention, organizer insert 10 also is provided with inside vertical panels 22, 24 and 26, as well as inside horizontal panels 28, 30 and 32 which, as shown, extend between vertical panels 22 and 24 (in the case of panel 28), between panels 24 and 26 (in the case of panel 30), and between panel 26 and side panel 16 (in the case of panel 32) to form three additional compartments 25, 27, 29 in the insert 10. Each of the inside horizontal panels 28, 30 and 32 is provided with a respective slot 28*a*, 30*a* and 32*a*. Compartments 25, 27, and 29 are designed to hold other, smaller toiletry articles and to facilitate their removal by the user as described above. For instance, compartment 25 may be used to store dental floss, etc.; compartment 27 may be used to store a container of razor blades, etc.; and compartment 29 may be used to store contact lenses, etc. The slots 28*a*, 30*a*, and 32*a* will facilitate removal of those articles or containers from the respective compartment since the index finger may be passed through the slot to grasp the bottom of the article or container.

Figure 2:
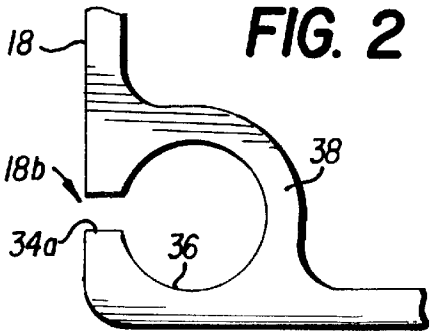
FIG. 2 is an enlarged detail front view of a typical groove contained in the organizer insert of FIG. 1.

FIG. 2 is an enlarged detail of a typical groove contained in each of the four comers of the organizer insert 10 of FIG. 1. As seen therein, the typical groove 18*b* is cylindrical in shape and is formed by integrally molding a cylindrical portion 38 into a comer portion (in this case, a lower comer portion) of side panel 18. In the molding process, a small gap or slot 34*a* is formed in side panel 18, and extends horizontally along side panel 18 from front to rear of the organizer insert 10. The interior surface 36 of cylindrical portion 38 of groove 18*b* is shaped to receive a corresponding cylindrical protruding portion 33 (FIG. 1) of a specialized attachment 35, in this case a flat shelf attachment, which may be removably secured to the organizer insert 10, as will be described in more detail below. The shelf attachment 35 may comprise a separate attachment or it may be inverted to function as a soap dish as also described below.

FIG. 3 is a perspective view of a cup holder attachment which may be used in conjunction with the organizer insert 10 of FIG. 1. As seen therein, cup holder 40 comprises a circular frame 42 defining an opening 42*a* and having a plurality of standoffs 44*a* and 44*b* (only two shown) arranged in equi-angularly spaced relation about the opening 42*a*. Although three or more standoffs may be used, preferably, eight standoffs are molded into the cup holder. The standoffs 44*a*, 44*b*, etc. are used to accommodate a tapered paper or plastic water cup and prevent the cup from becoming lodged in the circular frame 42. Cup holder 40 further comprises a cylindrical protruding portion 46 attached by a horizontal plate portion 48 to the circular frame 42. Cylindrical protruding portion 46 is provided in order to removably connect the cup holder 40 to one of the grooves 16*a*, 16*b*, 18*a*, or 18*b* of the organizer insert 10 of FIG. 1.

Specifically, if it is desired to attach the cup holder 40 to the organizer insert 10, an end portion 46*a* of cylindrical protruding portion 46 is inserted into an open end of a groove, such as groove 18*b* (FIG. 1), of organizer insert 10, and the cylindrical protruding portion 46 is then slid toward the rear of insert 10 until it is fully positioned in the groove 18*b* with the plate portion 48 extending through slot 34*a* (FIG. 2) of the groove. In the example just described, cup holder 40 would then extend to the left (in FIG. 1) of the organizer insert 10. Of course, cup holder 40 can be mounted in any of the grooves 16*a*, 16*b*, 18*a* or 18*b* of insert 10.

FIG. 4 is a soap dish attachment used in conjunction with the organizer insert 10 of FIG. 1. As seen therein, soap dish 60 comprises a base 62 and a surrounding frame 64 for retaining the soap. Ribs 66 are provided in base 62 in order to retain the soap in position supported above any water that may be standing in the dish, a technique which is well-known to those of skill in the art.

Soap dish 60 is also provided with a cylindrical protruding portion 68 and plate portion 69 for connecting the soap dish 60 to the organizer insert 10 of FIG. 1. That is to say, in a manner similar to that described with respect to the cup holder 40 of FIG. 3, an end portion 68*a* of the cylindrical protruding portion 68 of soap dish 60 is inserted into an open end of one of the grooves, such as groove 18*b*, of insert 10, and the cylindrical protruding portion 68 is then slid to the rear of the insert 10 until it is fully positioned therein with the plate portion 69 extending through slot 34*a* (FIG. 2). In the example just described, soap dish 60 would then extend to the left (in FIG. 1) of organizer insert 10. Of course, it should be recognized that soap dish 60 can be connected to organizer insert 10 in any of the grooves 16*a*, 16*b*, 18*a* or 18*b* of insert 10 of FIG. 1.

As a further unique feature of the soap dish 60, the bottom surface 70 thereof may be flat so as to form a shelf extension similar to shelf attachment 35 shown in FIG. 1. Thus, the soap dish 60 can be inverted and its protruding portion 68 inserted in one of the grooves 16*a*, 16*b*, 18*a* or 18*b* of insert 10 of FIG. 1 to form a shelf extension.

The organizer insert 10 is preferably attached inside a medicine cabinet in addition to, or in place of, one or more of the conventional shelves in the cabinet. For making such attachment, two or more holes 72 (only one shown in FIG. 1) are provided in the rear wall 20 of the insert through which conventional fasteners may be used to attach the insert to the rear wall of the cabinet. If desired, the organizer insert may be attached to a wall in the same manner.

From the foregoing description, it will be appreciated that the present invention provides a unique medicine cabinet organizer that may be specially configured with one or more different types of attachments to suit the desires and requirements of the user. The organizer insert may be sold with a selection of attachments, such as attachments 35, 40, 60 or other specially designed attachments, so that the user has a variety of choices of attachments to install. Because the attachments are easily removed, the user may also vary the selection of attachments if desired.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. An article organizer for supporting a plurality of articles, comprising a top wall and a bottom wall interconnected by two side walls, said bottom wall having at least one slot formed therein for holding a respective one of said articles or facilitating removal thereof, an attachment for supporting one of said articles and having a protruding portion, and at least one of said side walls having groove means receiving the protruding portion of said attachment for removably connecting said attachment to said side wall.

2. The organizer of claim 1, further comprising a rear wall interconnecting said top, bottom and two side walls, at least one inner vertical wall connected to said top and rear walls, and an inner horizontal wall connected to said at least one inner vertical wall, and means in said rear wall for mounting said organizer in a medicine cabinet.

3. The organizer of claim 2, wherein said inner horizontal wall has at least one slot formed therein for holding a respective one of said articles or facilitating removal thereof.

4. The organizer of claim 1, wherein said attachment comprises a cup holder.

5. The organizer of claim 1, wherein said attachment comprises a soap dish.

6. The organizer of claim 1, wherein said attachment comprises a shelf extension.

7. The organizer of claim 1, wherein said attachment comprises a combination soap dish/shelf extension.

8. The organizer of claim 1, wherein said groove means comprises a cylindrical groove and a longitudinal slot, said protruding portion comprising a plate portion and a cylindrical portion, the cylindrical portion being slidably and removably received in the cylindrical groove and the plate portion being slidably and removably received in the longitudinal slot.

9. In combination, an article organizer and an attachment for supporting an article on said organizer, said organizer holding a plurality of articles and comprising a top wall and a bottom wall interconnected by two side walls, at least one of said side walls having a cylindrical groove and a longitudinal slot, said attachment having a protruding portion comprising a plate portion and a cylindrical portion, the cylindrical portion being slidably and removably received in the cylindrical groove and the plate portion being slidably and removably received in the longitudinal slot, means for mounting said organizer in a medicine cabinet.

10. The combination of claim 9, wherein said organizer further comprises a rear wall interconnecting said top, bottom and two side walls, at least one inner vertical wall connected to said top and rear walls, and an inner horizontal wall connected to said at least one inner vertical wall, said inner horizontal wall having at least one slot formed therein for holding one of said articles or facilitating removal thereof.

11. The combination of claim 9, wherein said attachment comprises a cup holder including an annular frame defining an opening of said cup holder, and standoff means for supporting a cup in said frame when said cup is inserted into said opening.

12. The combination of claim 9, wherein said attachment comprises a combination soap dish/shelf extension.

13. The combination of claim 9, wherein said bottom wall has at least one slot formed therein for holding one of said articles or facilitating removal thereof from the organizer.

* * * * *